US008196265B2

(12) United States Patent
Neukoetter et al.

(10) Patent No.: US 8,196,265 B2
(45) Date of Patent: Jun. 12, 2012

(54) CONCEALED DOOR HINGE

(75) Inventors: Hubert Neukoetter, Beelen (DE); Nicolas Liermann, Rheda-Wiedenbrueck (DE)

(73) Assignee: Simonswerk GmbH, Rheda-Wiedenbrueck (DE)

( * ) Notice: Subject to any disclaimer, the term of this patent is extended or adjusted under 35 U.S.C. 154(b) by 317 days.

(21) Appl. No.: 12/611,982

(22) Filed: Nov. 4, 2009

(65) Prior Publication Data

US 2010/0122431 A1 May 20, 2010

(30) Foreign Application Priority Data

Nov. 14, 2008 (DE) ..... 10 2008 057 341

(51) Int. Cl.
*E05D 7/04* (2006.01)
*E05D 5/06* (2006.01)

(52) U.S. Cl. ..... 16/389; 16/238; 16/387; 16/382; 16/366; 16/236

(58) Field of Classification Search ..... 16/389, 16/355, 356, 357, 361, 362, 366, 368, 369, 16/236, 237, 238, 245, 382
See application file for complete search history.

(56) References Cited

U.S. PATENT DOCUMENTS

| | | | | | |
|---|---|---|---|---|---|
| 3,209,390 | A | | 10/1965 | Bassan | 16/164 |
| 3,596,307 | A | * | 8/1971 | Kolmetsky | 16/237 |
| 3,626,548 | A | * | 12/1971 | Grunert | 16/358 |
| 3,863,292 | A | * | 2/1975 | Grunert et al. | 16/236 |
| 3,886,627 | A | * | 6/1975 | Bassan | 16/387 |
| 4,434,523 | A | * | 3/1984 | Grass | 16/242 |
| 4,720,896 | A | * | 1/1988 | Lautenschlager et al. | 16/382 |
| 5,133,109 | A | * | 7/1992 | Mariani | 16/238 |
| 5,685,046 | A | * | 11/1997 | Neag et al. | 16/366 |
| 5,694,665 | A | * | 12/1997 | Strickland et al. | 16/238 |
| 6,421,877 | B1 | * | 7/2002 | Mih | 16/238 |
| 6,430,779 | B1 | * | 8/2002 | Goldsmith et al. | 16/382 |
| 6,487,755 | B1 | * | 12/2002 | Caldari | 16/370 |
| 6,647,591 | B1 | * | 11/2003 | Domenig et al. | 16/242 |
| 2002/0023314 | A1 | * | 2/2002 | Goldsmith et al. | 16/372 |
| 2003/0088943 | A1 | | 5/2003 | Neukotter | 16/366 |
| 2004/0205932 | A1 | * | 10/2004 | Sitter | 16/250 |
| 2007/0028420 | A1 | * | 2/2007 | Lueffe et al. | 16/382 |

FOREIGN PATENT DOCUMENTS

| | | | |
|---|---|---|---|
| DE | 202005018102 | | 3/2006 |
| DE | 202006004198 | | 7/2006 |
| EP | 1780357 | | 5/2007 |
| JP | 04027089 | | 1/1992 |
| JP | 2007177427 | A * | 7/2007 |
| JP | 2007211577 | A * | 8/2007 |
| JP | 2008025270 | A * | 2/2008 |

* cited by examiner

*Primary Examiner* — Chuck Y. Mah
(74) *Attorney, Agent, or Firm* — Andrew Wilford

(57) ABSTRACT

A concealed door hinge has first and second leaf assemblies fittable into respective mortises in an edge of the door and in the door frame. The first leaf assembly has a body, mounting tabs at ends of the body and securable to the door frame or to an edge of the door, and an insert shiftable in the body in a first horizontal direction perpendicular to a face of the assembly. The body is also shiftable relative to the tabs in a second horizontal direction transverse to the horizontal direction and parallel to the face. A swivel mechanism is connected between the second leaf assembly and the insert of the assembly. Adjusters engaged between the insert, the body, and the tabs can relatively secure the insert and body in any of a plurality of positions offset relative to one another in the horizontal directions.

16 Claims, 3 Drawing Sheets

CONCEALED DOOR HINGE

FIELD OF THE INVENTION

The present invention relates to a door hinge. More particularly this invention concerns a concealed door hinge.

BACKGROUND OF THE INVENTION

A door hinge for concealed installation between a door frame and a door typically has a first and a second leaf assembly fittable into respective mortises in the edge of the door and in the door frame. At least the first leaf assembly has a body and mounting tabs that secure it to the door or frame and are provided at ends of the body. This body is adjustable relative to the mounting tabs. A two-part swivel mechanism connects the leaf assemblies.

Such a door hinge for concealed installation between a door frame and a wing of a door is known from EP 1 780 357. Each leaf assembly has a body and two mounting tabs at ends of the body. The mounting tabs each comprise a front plate and a rear plate. On one of the leaf assemblies the body is adjustable vertically relative to the leaf assemblies, screws engaging into elongated holes in the body to connect the front plate to the rear plate at the mounting tabs. With the screws removed the body can be displaced vertically and may be fixed in the desired position by firmly resecuring the screws. In order to avoid subsequent slipping of the body the rear sides of the front plates and the confronting faces of the body have ridges. On the other leaf assembly the mounting tabs each have an adjustment screw that extends between the front plate and the rear plate and by means of which the body may be positioned orthogonally and horizontally relative to the front face of the leaf assembly. This way, lateral displacement of the door within the door frame is possible by operation of the adjustment screw. In this context side-to-side displacement means that the door can be adjusted in a horizontal direction extending parallel to the closed door. The door hinge further has a swivel mechanism comprising two members that are pivoted on each other at a vertical pivot axis. The members are each pivoted in a respective one of the bodies, and are guided in a displaceable manner in sliding guides at their other ends.

Further such door hinges, in which at least one of the leaf assemblies has a body and mounting tabs for mounting on a door or on a door frame, are also known from DE 20 2005 018 102 and DE 20 2006 004 198.

A door hinge is known from US 2003/0088943 that is mounted concealed between the door frame and the door. In addition to two leaf assemblies and a hinge-bracket arrangement, the door hinge described therein also comprises inserts secured in mounting locations. To this end according to the invention the inserts are vertically and/or horizontally adjustable. A complete adjustment of the door requires two horizontal adjustment directions and one vertical adjustment direction. Adjustment in the three axes enables a sufficiently accurate alignment of the door relative to the door frame when mounting the door to the door frame, that is to center the door in the frame and set it flush to the frame. The alignment should be carried out with regard to the height and in a side-to-side direction with the door closed and parallel to a direction extending parallel to the door, and in a direction extending perpendicular to the closed door. According to US 2003/0088943, horizontal adjusters are provided on both leaf assemblies such that the adjustment of the door with regard to the door frame must be carried out on both leaf assemblies. With an opening angle of the inserted but not yet adjusted door of about 90° the adjustment of the adjusting paths for the adjustment in the one horizontal direction and in the other horizontal direction are additive, thus significantly complicating the installation, especially for the layperson. A further embodiment according to US 2003/0088943 provides the inserts on one of the leaf assemblies in two horizontal directions. Such an embodiment facilitating adjustment is extremely complex. Furthermore, the capacity of the door hinge is further limited by providing a second horizontally adjustable embodiment of the inserts.

OBJECTS OF THE INVENTION

It is therefore an object of the present invention to provide an improved concealed door hinge.

Another object is the provision of such an improved concealed door hinge that overcomes the above-given disadvantages, in particular that also has a high stability and enables easy horizontal adjustment of the door.

In particular, the door hinge should also be of simple construction, thus being cost-effective with regard to its manufacture.

SUMMARY OF THE INVENTION

A door hinge for concealed installation between a door frame and a door has according to the invention a first leaf assembly and a second leaf assembly fittable into respective mortises in an edge of the door and in the door frame. The first leaf assembly has a first body, mounting tabs at ends of the first body and securable to the door frame or to an edge of the door, and an first insert shiftable in the first body in a first horizontal direction perpendicular to a face of the first assembly. The first body is also shiftable relative to the tabs in a second horizontal direction transverse to the first horizontal direction and parallel to the face. An at least two-part swivel mechanism is connected between the second leaf assembly and the first insert of the first assembly. A first adjuster engaged between the first insert and the first body can relatively secure the first insert and first body in any of a plurality of positions offset relative to one another in the first horizontal direction. A second adjuster engaged between the first body and the tabs can relatively secure the first body relative to the tabs in any of a plurality of positions relatively offset in the second horizontal direction.

This adjustment possibility in the second horizontal direction is a horizontal push-in adjustment of the door relative to the door frame, the door being adjustable perpendicular to the plane of the closed door. This ensures that the first and second adjusters are mounted on only one leaf assembly of the door hinge. The one-sided arrangement of both horizontal adjusters significantly eases work for the installer during installation of the door. While installing the door, the hinge according to the invention may be inserted such that the adjusters are optionally arranged either in the leaf assembly on the door or on the door frame such that the horizontally adjustable inserts are arranged in that leaf assembly that is associated with the door.

Another aspect of the present invention relates to the concealed installation of a door hinge between the door frame and the door and having at least one leaf assembly with a body and mounting tabs at ends thereof, the tabs being one-piece plates. While embodiments are known from the prior art where the mounting tabs have a front and a rear plate, the present invention is based on the discovery that in a suitable constructive embodiment one-piece and essentially plate-shaped mounting tabs suffice for mounting the leaf assemblies on a door or on a door frame. To this end the mounting tabs usually have holes for attachment to the body and to fix the entire leaf assembly on the door or on the door frame. Since only plate-shaped mounting tabs are provided within the scope of the preferred embodiment described that are carried on the body, a shallow installation depth may be used in the end regions of the leaf assemblies such that only shallow flat milling is required at the ends of the respective mortises of the door and at the door frame, by means of which both stability is increased and installation expense can be reduced.

In order to enable adjustment at the first leaf assembly between the mounting tabs and the body in the second horizontal direction the mounting tabs may be equipped with, for example, a horizontally elongated hole at that location with a retaining screw engaging into the elongated hole for fixing it in the desired position relative to the body. To this end the body may, for example, have a threaded bore accommodating the screw, or a threaded insert. Horizontal adjustability in the second horizontal direction is achieved in a particularly simple manner by means of the embodiment described.

If one-piece, essentially plate-shaped mounting tabs are provided on the second leaf assembly, they may be provided, for example, with elongated holes extending vertically in order to be able to position the body vertically relative to the mounting tabs. To this end essentially plate-shaped means within the scope of the invention an embodiment of the mounting tabs with a planar front face and a planar rear surface at least in sections extending from the body. However, it should not be excluded for this purpose that moldings for accommodating an adjuster or recesses for saving material, at least in sections, are provided.

It is within the scope of the invention that an adjuster is arranged on each of the mounting tabs of the first leaf assembly to enable precise adjustment of the mounting tabs relative to the body in the second horizontal direction. To this end the adjuster may have an eccentric pivoted at an axis perpendicular to the front of the leaf assembly in the body or to the respective mounting tab. As an alternative it may also be that the adjuster has an adjustment screw acting on a wedge face of the body or on an additional wedge extending from the body so that pivoting of the adjustment screw displaces the body relative to the respective mounting tab.

Preferably adjusting screws are provided on the first leaf assembly for adjusting the inserts in the first horizontal direction and connecting the inserts with the body. The adjusting screws may be oriented such that their axes extend horizontally perpendicular to the front face of the leaf assembly. In this manner the inserts may be adjusted within the body in the x direction, thus enabling a side-to-side adjustment of the door.

As explained above, vertical adjustment may be enabled in the second leaf assembly in that a body is provided at that location with mounting tabs at ends of the body such that the body can be adjusted vertically relative to the mounting tabs. Such adjustability may be achieved in that vertically elongated holes are provided on the mounting tabs and the body is fixed in the desired position by retaining screws. One disadvantage is, however, that the weight of the door must be supported by an installer during the installation. Particularly in case of a heavy door, handling is cumbersome so that precise alignment may be difficult due to the great exertion required. In order to facilitate alignment vertically at the second leaf assembly, an adjuster may be provided for the vertical adjustment in addition to the embodiment of elongated holes. Within the scope of a preferred embodiment the adjuster has an adjustment screw acting on a wedge and fitted to a threaded bore of the respective mounting tab. To this end the adjustment screw acts upon a 45° cam face of the wedge that is aligned at a right angle to the adjustment screw, the wedge extending from the body opposite the wedge face. Advantageously, the adjustment screw has a rounded or conical tip that acts upon the wedge face. In order to adjust the body vertically on the second leaf assembly on installation, the adjustment screw merely has to be screwed in at the lower mounting tab in order to lift the body, or screwed out to lower the body. Even if only the lower mounting tab needs to have the described adjuster during installation of the door hinge, adjusters are preferably provided on both mounting tabs of the second leaf assembly such that the door hinge may be inserted in the same manner for left or right-hand doors without any problems. The adjuster must then be loosened on the mounting tab on the top during installation such that sufficient clearance is available. If the body is set at the desired vertical position by the adjuster, clamping of the body is advantageously carried out at both mounting tabs.

Within the scope of the invention the swivel mechanism may have two hinge brackets pivoted on at a common pivot axis, each hinge bracket being pivoted at one end and being displaceable at the other end in a respective guide slot. Such hinge brackets are characterized by excellent stability while simultaneously requiring only a low manufacturing expense. The arrangement also has the effect that the hinge brackets substantially fill the space within the leaf assemblies provided therefore during the closing of the door such that the construction is very compact construction. This essential for concealed door hinges. Furthermore, the swivel mechanism may also be formed of scissor-like hinge brackets merely pivoted in the leaf assemblies. To this end hinge brackets of a first hinge bracket type are pivoted in the leaf assemblies at the ends thereof while the hinge brackets of this type are arranged on the first leaf assembly and on the second leaf assembly are arranged vertically offset from each other, and are connected at a center section at a pivot axis. Furthermore, hinge brackets of a second hinge bracket type are provided that are usually comparatively short and are pivoted on each other one of their ends about a vertical pivot axis in the leaf assemblies, and at their other end to the free ends of the hinge bracket of the first hinge bracket type that is offset. Such door hinges are known, for example from DE 1 873 512 [U.S. Pat. No. 3,209,390] and JP 04027 089A (abstract). Finally, embodiments may also be provided in which a hinge bracket is pivoted at both of its ends and at least one control lever is provided for controlling the pivoting movement.

In a further embodiment of the door hinge according to the invention it is advantageous to provide covers attachable to and releasable from the installation surfaces. The covers may be sheet metal with a shape conforming to the installation surfaces and a color selected that is identical to the color of the door frame. In this manner the appearance of the concealed door hinge that is already perceived as appealing is additionally enhanced.

The reference to the vertical direction and the horizontal directions refers to the common arrangement of a door hinge according to the invention within the scope of the invention, and merely serves as an explanation of the embodiment with regard to the construction. Skew or horizontal mounting of the hinges is of course possible within the scope of the invention.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
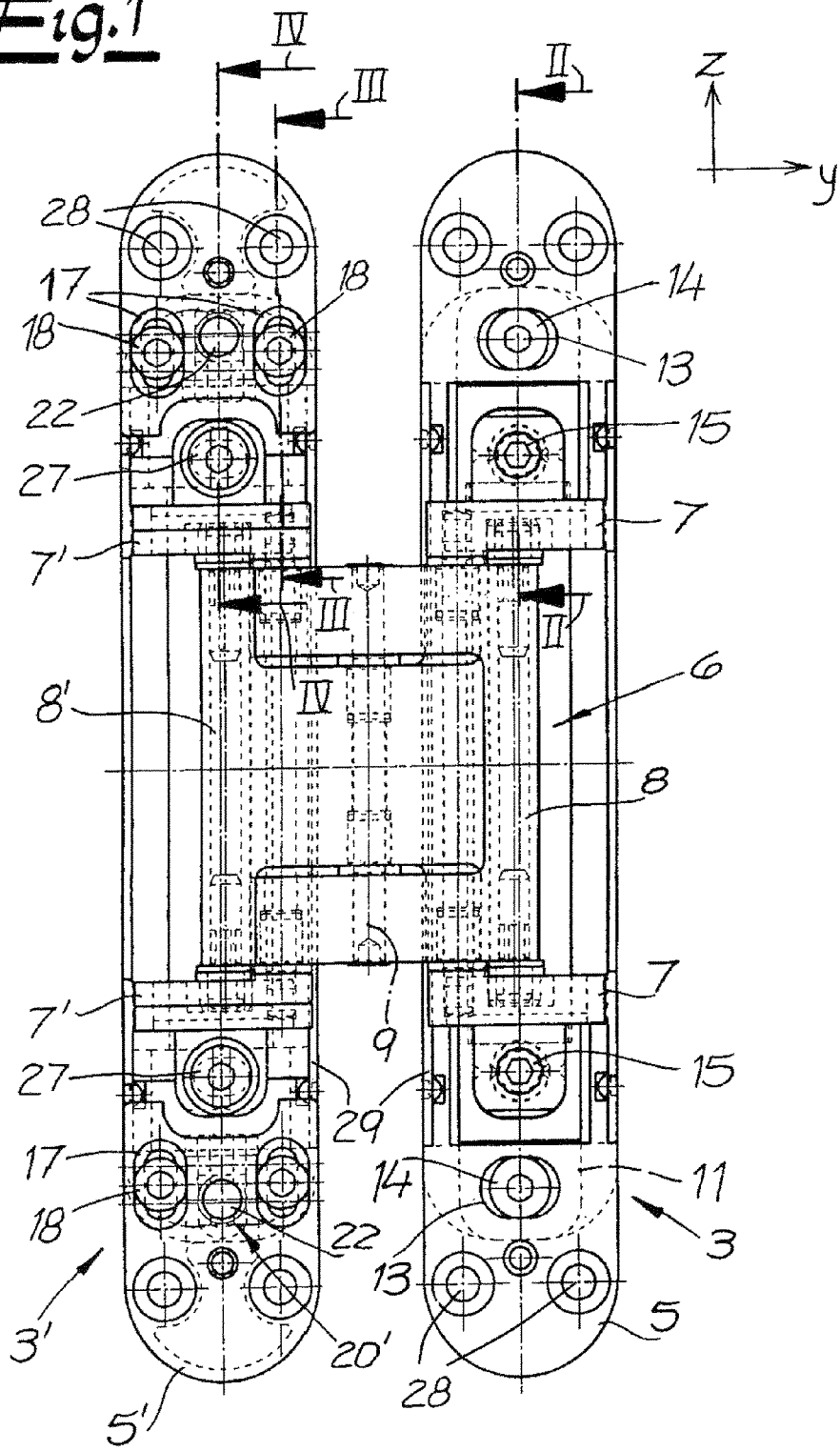
FIG. 1 is a schematic side view of a door hinge in the fully opened position.

As seen in FIG. 1 a door hinge for concealed installation between a door frame 1 and a door 2 has first and second leaf assemblies 3, 3' settable into respective mortises 4, 4' in the edge of the door 2 and in the door frame 1, and respective mounting tabs 5, 5' having holes 28 for mounting on the door 2 and the door frame 1. The door hinge further comprises a two-part swivel mechanism 6 supported on inserts 7, 7' in the leaf assemblies 3, 3'. To this end the swivel mechanism 6 has two hinge brackets 8, 8' pivoted on each other at a common vertical and central pivot axis 9.

Figure 5:
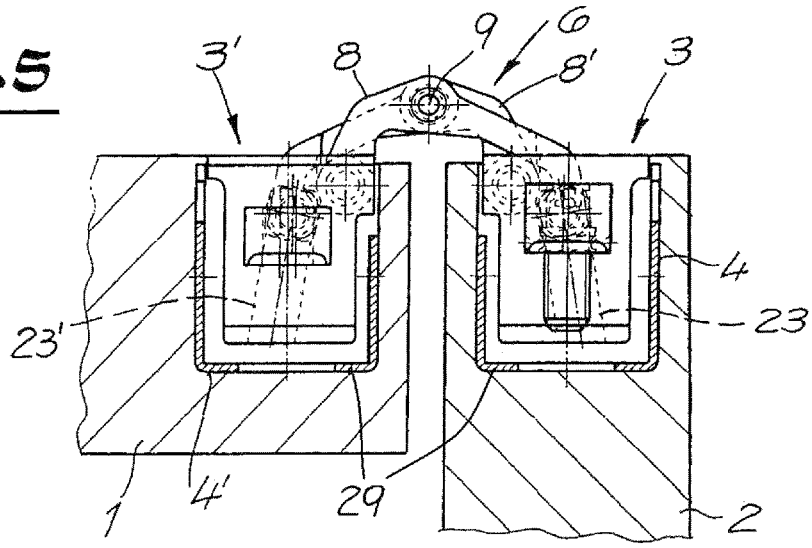
FIG. 5 is a horizontal section through the door hinge in the opened position.

The insert 7 of the first leaf assembly 3 is shiftable for adjustment in a first in/out horizontal direction x orthogonal to a front face of the first leaf assembly 3. This insert 7 is mounted in a first body 11 of the first leaf assembly 3 itself movable relative to the mounting tabs 5 of this leaf assembly 3 in a second side/side horizontal direction y perpendicular to the first movement direction x of the inserts 7 and parallel to the face of the assembly 3 and to the edge of the door 2 (FIG. 5). The mounting tabs 5 are one-piece plates, typically formed of cast metal. Each tab 5, 5' is formed with a pair of the countersunk mounting holes 28 by means of which the respective assembly 3, 3' can be screwed to the door frame 1 or door 2.

Figure 2:
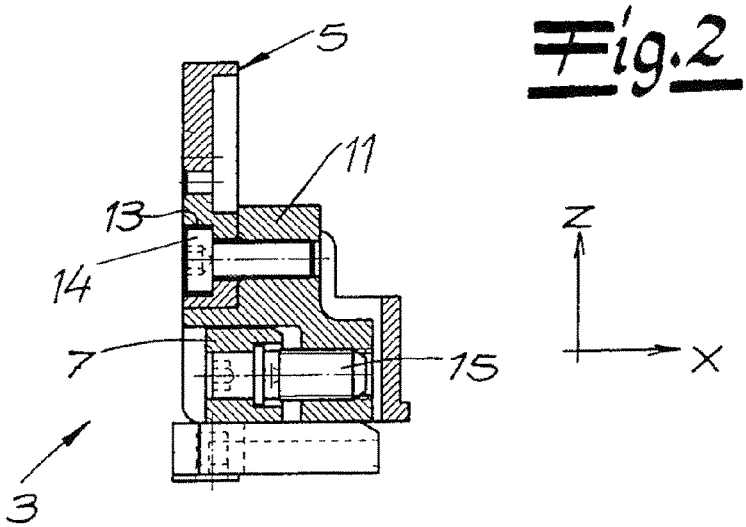
FIG. 2 is a section along line II-II of FIG. 1.

Each tab 5 has a horizontally elongated and throughgoing hole or slot 13 by means of which it is secured to the first body 11 by a respective retaining screw 14 engaging through the elongated hole 13, as shown in FIG. 2. These holes 13 and screws 14 form a first adjuster Furthermore, adjusting screws 15 connect the insert 7 to the first body 11 for moving the insert 7 in the first horizontal in/out direction x. These screws 15 form part of a second adjuster.

Figure 3:
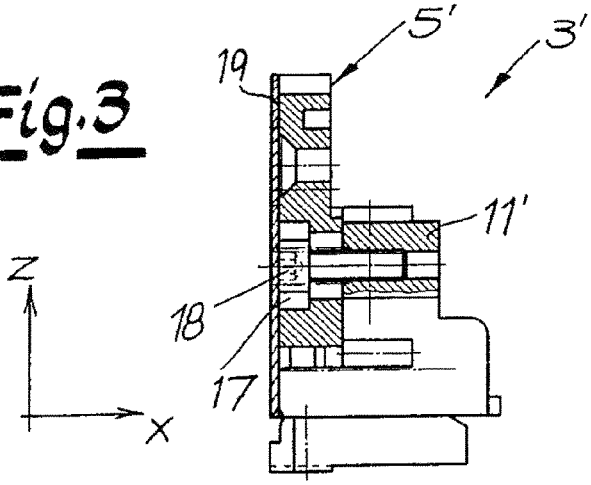
FIG. 3 is a section along line of FIG. 1.
Figure 6:
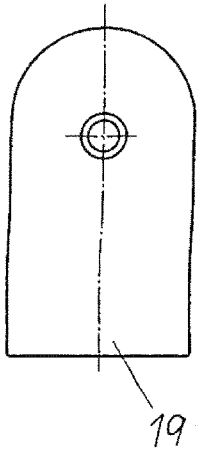
FIG. 6 is an elevational view of a cover for one of the installation surfaces.

As shown in FIG. 3, the mounting tabs 5' of the second assembly 3' are also one-piece plates and the respective second body 11' can move in a vertical direction z perpendicular to the directions x and y relative to the tabs 5' of the second leaf assembly 3'. FIG. 3 also shows that the mounting tabs 5' each have two vertically elongated holes 17, and are detachably seated in the second body 11' by retaining screws 14' that engage through the elongated holes 17. A cover plate 19 can be attached to and removed from the mounting tabs 5, 5' is also shown in FIG. 6.

Figure 4:
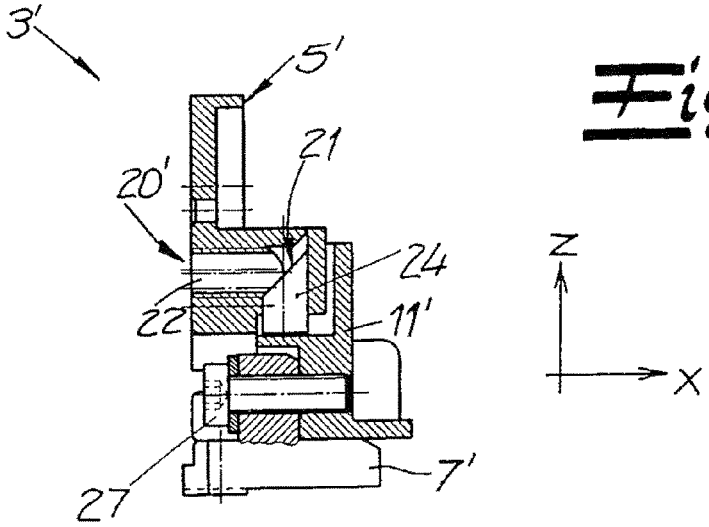
FIG. 4 is a section along line IV-IV of FIG. 1.

FIG. 4 shows that a mechanical third adjuster 20' for vertical adjustment of the second body 11' is provided in each mounting tab 5' of the second leaf assembly 3'. Each adjuster 20' has an adjustment screw 22 that bears on a cam or wedge face 21 of the second body 11', or, as illustrated in FIG. 4, acts upon a wedge 24 projecting from the second body 11', this wedge 24 being aligned at a right angle to the respective adjustment screw 22. FIG. 4 also shows that the inserts 7' in the second leaf assembly 3' are attached to the respective second body 11' by screws 27. Thus the insert 7' is fixed by the screws 27 in the respective second body 11' so that only vertical adjustability is possible in the second leaf assembly 3', as opposed to two degrees of horizontal adjustability in the first leaf assembly 3.

FIG. 5 shows that the swivel mechanism 6 has the two hinge brackets 8, 8' that are pivoted on each other at the common pivot axis 9. They are each also pivoted at one end in one of the inserts 7, 7' and displaceably supported at the other end in guide slots 23, 23' (FIG. 5) of the other of the inserts 7, 7'. In addition FIG. 5 shows a hollow generally U-section housing part 29 fixed to and extending vertically longitudinally between each of the pairs of mounting tabs 5, 5'. The first body 11 is set in the respective part 29 with vertical and horizontal clearance.

Figure 7:
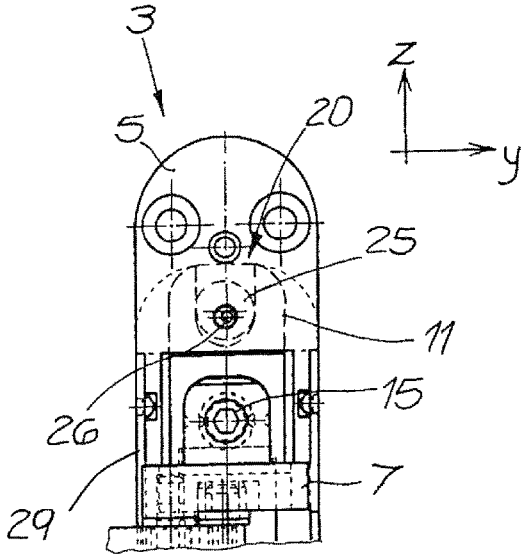
FIG. 7 is a side view of a leaf assembly having an eccentric adjuster for the second horizontal direction.

FIG. 7 shows an alternative embodiment of the first attachment part 3 where the second adjuster is provided on both of the mounting tabs 5 for adjustment of the mounting tab 5 relative to the first body 11 in the second horizontal direction y. The adjuster 20 has an eccentric 25 pivoted in the first body 11 at an axis 26 perpendicular to the front side of the first leaf assembly 3. This eccentric 25 bears radially of its horizontal pivot axis on the first body 11 so that when rotated it shifts the first body 11 in the second side/side direction y.

We claim:

1. A door hinge for concealed installation between a door frame and a door, the hinge comprising:

a first leaf assembly and a second leaf assembly fittable into respective mortises in an edge of the door and in the door frame, the first leaf assembly having a first body having ends, respective mounting tabs at the ends of the first body and securable to the door frame or to an edge of the door, and a first insert shiftable in the first body in a first horizontal direction perpendicular to a face of the first assembly, the first body being shiftable relative to the tabs in a second horizontal direction transverse to the first horizontal direction and parallel to the face, the second leaf assembly similarly having a second body having ends, respective mounting tabs at ends of the second body and securable to the door frame or to an edge of the door, and a second insert in the second body;

an at least two-part swivel mechanism connected between the second insert of the second leaf assembly and the first insert of the first assembly;

first adjusting means engaged between the first insert and the first body for relatively securing the first insert and first body in any of a plurality of positions offset relative to one another in the first horizontal direction; and second adjusting means engaged between the first body and the tabs for relatively securing the first body relative to the tabs in any of a plurality of positions relatively offset in the second horizontal direction.

2. The concealed hinge defined in claim 1 wherein the mounting tabs are each a one-piece plate.

3. The concealed hinge defined in claim 2, further comprising a respective hollow generally U-section housing part fixed to and extending vertically longitudinally between the mounting tabs of each of the leaf assemblies, the first body being set in the respective housing part with vertical and horizontal clearance.

4. The concealed hinge defined in claim 2 wherein each of the mounting tabs is formed with at least throughgoing hole adapted to receive a screw securing the mounting tab to the door edge or frame.

5. The concealed hinge defined in claim 2 wherein the mounting tabs each have a throughgoing hole and the second adjusting means includes respective retaining screws engaging through the holes and into the first body.

6. The concealed hinge defined in claim 5 wherein the holes are each elongated in the second direction and each retaining screw is threaded into the first body and has a head bearing on the respective tab.

7. The concealed hinge defined in claim 2 wherein the first adjusting means includes a screw extending in the first horizontal direction and having an externally accessible head bearing on the insert and a shank threaded into the body.

8. The concealed hinge defined in claim 7 wherein the screw of the first adjusting means is coupled in the first direction to the insert for joint movement in the first horizontal direction therewith.

9. The concealed hinge defined in claim 2 wherein the second adjusting means includes an eccentric rotatable about a horizontal axis vertically fixed in the second insert or in the second body.

10. The concealed hinge defined in claim 9 wherein the horizontal axis is fixed in the second body and the eccentric bears radially on the second insert.

11. The concealed hinge defined in claim 1 wherein the second insert is shiftable in the second body in a vertical direction perpendicular to the horizontal directions, the hinge further comprising:

third adjusting means for relatively shifting the second body and second insert vertically through a plurality of positions offset vertically relative to one another and for securing the second body and second insert relative to each other in any of the respective positions.

12. The concealed hinge defined in claim 11 wherein the mounting tabs of the second assembly are fixed to the second body, whereby the second assembly is adjustable only vertically.

13. The concealed hinge defined in claim 11 wherein the third adjusting means includes an angled cam face fixed on the second insert and a horizontally extending screw threaded into one of the second mounting tabs and bearing on the respective face, whereby screwing the screw in cams the second insert vertically.

14. The concealed hinge defined in claim 13 wherein the third adjusting means includes a wedge fixed to the second insert, slidable in the one second mounting tab, and formed with the angled cam face.

15. The concealed hinge defined in claim 14 wherein the angled cam face extends at an angle of about 45° to the vertical.

16. The concealed hinge defined in claim 1 wherein the swivel mechanism includes a pair of brackets that are pivoted together at a common vertical pivot axis and that each have one end pivoted at another vertical axis in one of the leaf assemblies and an opposite end horizontally guided and slidable in the other of the leaf assemblies.

* * * * *